US005403166A

United States Patent [19]

Pingiotti

[11] Patent Number: 5,403,166

[45] Date of Patent: Apr. 4, 1995

[54] DRAIN FLUSHING DEVICE WITH TOP MOUNTED FUNNEL SHAPED LIQUID INLET CAVITY

[76] Inventor: Ercolano Pingiotti, 5630 Paul Sauvé, St. Léonard, Qué, Canada, H1P 1L1

[21] Appl. No.: 141,925

[22] Filed: Oct. 28, 1993

[30] Foreign Application Priority Data

Oct. 30, 1992 [GB] United Kingdom ..... 9222804

[51] Int. Cl.[6] ..... F04B 7/04

[52] U.S. Cl. ..... 417/437; 417/490; 417/550; 4/255.03

[58] Field of Search ..... 417/98, 104, 150, 313, 417/437, 490, 550; 92/142; 4/255.01, 255.02, 255.03

[56] References Cited

U.S. PATENT DOCUMENTS

| | | | |
|---|---|---|---|
| 1,684,880 | 9/1928 | Norton | 4/255.02 |
| 4,096,597 | 6/1978 | Duse | 4/255 |
| 4,186,451 | 2/1980 | Ruo | 4/255 |

FOREIGN PATENT DOCUMENTS

| | | | |
|---|---|---|---|
| 216736 | 8/1958 | Australia | 4/255.02 |
| 35296 | 4/1886 | Germany | 417/490 |
| 320683 | 8/1934 | Italy | 417/490 |
| 517766 | 3/1955 | Italy | 417/490 |
| 615148 | 1/1961 | Italy | 4/255.04 |
| 29647 | 4/1933 | Netherlands | 417/490 |
| 815903 | 10/1951 | Netherlands | 417/490 |
| 131879 | 3/1951 | Sweden | 417/490 |
| 27057 | 11/1910 | United Kingdom | 417/490 |

*Primary Examiner*—Richard A. Bertsch
*Assistant Examiner*—Roland G. McAndrews, Jr.

[57] ABSTRACT

A drain flushing device for allowing a user to unclog a drain in either of two modes. The user is given the option to either use the device as a liquid column guide or as a pump.

4 Claims, 4 Drawing Sheets

DRAIN FLUSHING DEVICE WITH TOP MOUNTED FUNNEL SHAPED LIQUID INLET CAVITY

This invention relates to the field of plumbing accessories and is particularly concerned with a drain flushing device for allowing a user to unclog a drain in either of two modes. The user is given the option to either use the device as a liquid column guide or as a pump.

BACKGROUND OF THE INVENTION

Water drains are usually clogged by a blockage of foreign matter in the trap area of the drain system. If this blockage is broken up into smaller pieces or forced through the trap, the system will again function properly. Various methods can be used to break up the blockage into smaller particles or to force it through the trap. Examples of such methods include chemical reactions with the foreign matter and force exerted on the foreign matter. One of the methods of applying force to the foreign matter is the usage of water that is usually contained in the drainage system above the clogged area. Since the water is incompressible, any pressure applied above its surface will be directly transmitted to the foreign matter. A conventional method of applying pressure to the surface of the water is the use of a force cup plunger. The force cup plunger has a resilient plunger ring fixed to a substantially elongated handle. In operation, the plunger is positioned on the opening of the clogged drain. The user then pushes down and pulls up the plunger thereby alternatively exerting a downward pressure and a siphon on the water inside the clogged drain. Water being incompressible, the pressure and siphoning effect are transmitted to the clogging matter inside the drain, thus forcing the clogging matter inside the drain and releasing the latter. Because of the relatively small size of conventional plunger rings, the force cup plunger only displaces a small volume of water, thus exerting a limited pressure on the clogging matter. Another type of device conventionally used is the so-called piston-type pump. Piston-type pumps have been inherently complex and require complex piston seals. In operation, the piston-type pump is positioned on the opening of the clogged drain. The pump either uses water that is usually contained in the drainage system above the clogged area or, through an adapter, is hydraulically linked to a source of water under pressure, such as the conventional household water line. The piston inside the pump is reciprocated up and down along the cylindrical body, exerting a pressure and a siphoning effect on water present in the pump, thus releasing the clogging matter inside the clogged drain.

A search amongst prior art has revealed a number of patents disclosing devices either of the piston-type pump or of a type using an adapter for hydraulically linking a source of water under pressure, such as the conventional household water line, to an outlet nozzle which is positioned inside the drain to be unclogged. Examples of such patents are Canadian Patent No. 299,247 granted on Apr. 15, 1929 to Krieger, U.S. Pat. No. 3,934,280 granted on Jan. 27, 1976 to Tancredi, U.S. Pat. No. 4,096,597 granted on Jun. 27, 1978 to Duse and U.S. Pat. No. 4,186,451 granted on Feb. 5, 1980 to Ruo.

Canadian Patent No. 299,247 granted on Apr. 15, 1929 to Krieger discloses a pump for unclogging pipes. The pump comprises a cylinder, a plunger rod with an integral handle at one end and the other end threaded to receive nuts retaining a set of leather disc forming a piston for reciprocating within the cylinder. The bottom end of the cylinder is adapted to receive a flexible pipe such as a hose hydraulically linked to a domestic water line. The use of a water supply such as the domestic water line is essential to the operation of the pump, the water being the main source of pressure on the clogging matter. The handle linked to the piston is then reciprocated up and down in order to increase the pressure exerted on the clogging matter. This invention is adapted to function with running water and does not suitably function in the absence of an independent source of water.

U.S. Pat. No. 3,934,280 granted on Jan. 27, 1976 to Tancredi is concerned with a drain-flushing device comprising a cylinder closed at its upper end with a piston shaft support, a piston shaft passing there through with its top end connected to a handle and the bottom end connected to a piston. In operation, the user siphons up water which is inside the clogged drain by pulling up the handle and then applies a downward push on the handle, exerting a pressure on the water inside the cylinder and on the clogging matter. In the absence or insufficiency of water into the drain, the invention will not function properly.

U.S. Pat. No. 4,096,597 granted on Jun. 27, 1978 to Duse provides a drain opening device comprising telescoping cylinders sealed by a flexible plastic membrane. The bottom end of the bottom cylinder is covered with a pressure activated valve. The telescoped cylinders can be filled with water through the pressure activated valve. To unclog a drain, the top cylinder is pushed downwardly, thereby telescopingly overriding the bottom cylinder. The water inside the cylinder is thus forced through the pressure activated valve in the form of a high speed water jet. The invention has to be inverted and filled with water, which can prove unergonomical. Furthermore, the device is limited to a predetermined volume of liquid which can prove to be insufficient if the clogging matter is located at a distance from the device.

U.S. Pat. No. 4,186,451 granted on Feb. 5, 1980 to Ruo provides a sanitary pump comprising a cylinder, an elastic disc attached to the bottom of the cylinder, a piston, a piston rod, a cap covering the top of the cylinder and a handle connected to the upper end of the piston rod. In operation, the invention is placed and held on the opening of the clogged drain, the handle is pulled up and pushed down several times, thereby siphoning up and pushing down drain water thus exerting pressure on the clogging matter. Situations sometimes occur when not enough water is present in the clogged drain, or is present but not accessible, to fill the cylinder of this invention. The operation of the latter is thus complicated.

The present invention proposes a device adapted to circumvent the above-mentioned disadvantages.

SUMMARY OF THE INVENTION

An object of the present invention is to provide an improved drain flushing device.

Accordingly, the present invention allows the user to unclog a drain using a minimum amount of manipulations and relatively problem-free. Contrary to Canadian Patent No. 299,247 granted on Apr. 15, 1929 to Krieger, the present invention necessitates no running water, thus it is not exposed to the problem caused by the absence of the latter. Contrary to U.S. Pat. No.

3,934,280 granted on Jan. 27, 1976 to Tancredi and to U.S. Pat. No. 4,186,451 granted on Feb. 5, 1980 to Ruo, the proper operation of the present invention does not depend upon the presence of accessible water inside the clogged drain. The presence of apertures on the top of the cylinder eliminates the problem of possible insufficiency or absence of water inside the clogged drain, and the problem of unavailability of running water. Water can be poured inside a cylinder, part of the invention, through a set of apertures situated adjacent the top end of the cylinder. Contrary to U.S. Pat. No. 4,096,597 granted on Jun. 27, 1978 to Duse, it is not necessary to invert the invention and to use unergonomical manipulations in order to fill it with water. Furthermore, the presence of apertures at the top of the cylinder eliminates the necessity to handle the bottom part of the cylinder, which is often soiled because of its contact with the clogged and often dirty drain.

The present invention operates in either of two ways, as a water column exerting pressure on the clogging matter inside the clogged drain, or as pump.

BRIEF DESCRIPTION OF THE DRAWINGS

The present invention will be further understood from the following description with reference to the drawings in which.

DETAILED DESCRIPTION

Figure 1:
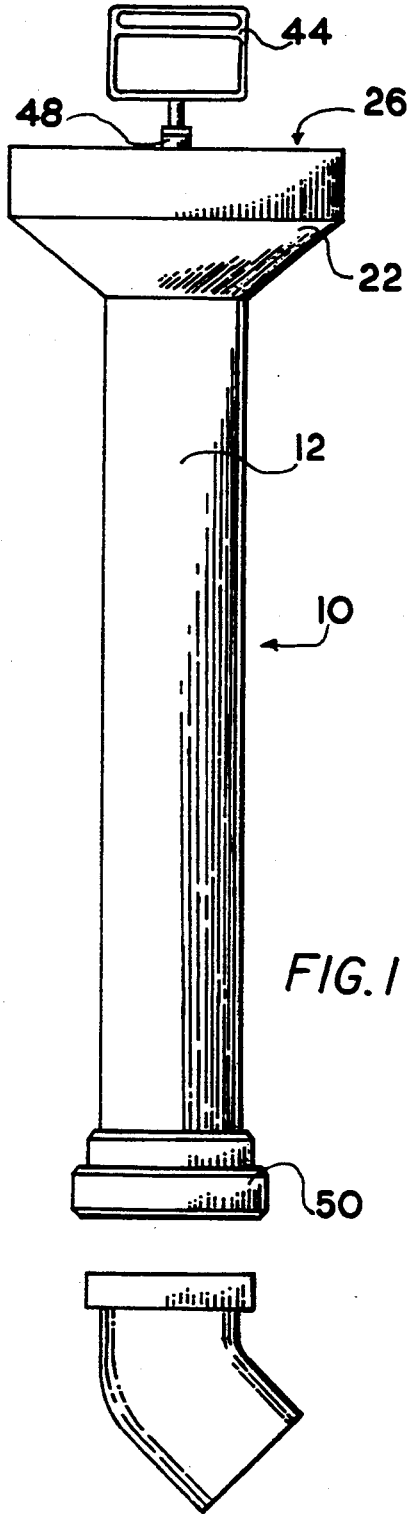
FIG. 1, in a perspective view, illustrates a drain flushing device in accordance with a first embodiment of the present invention positioned inside a sink about to be unclogged.
Figure 2:
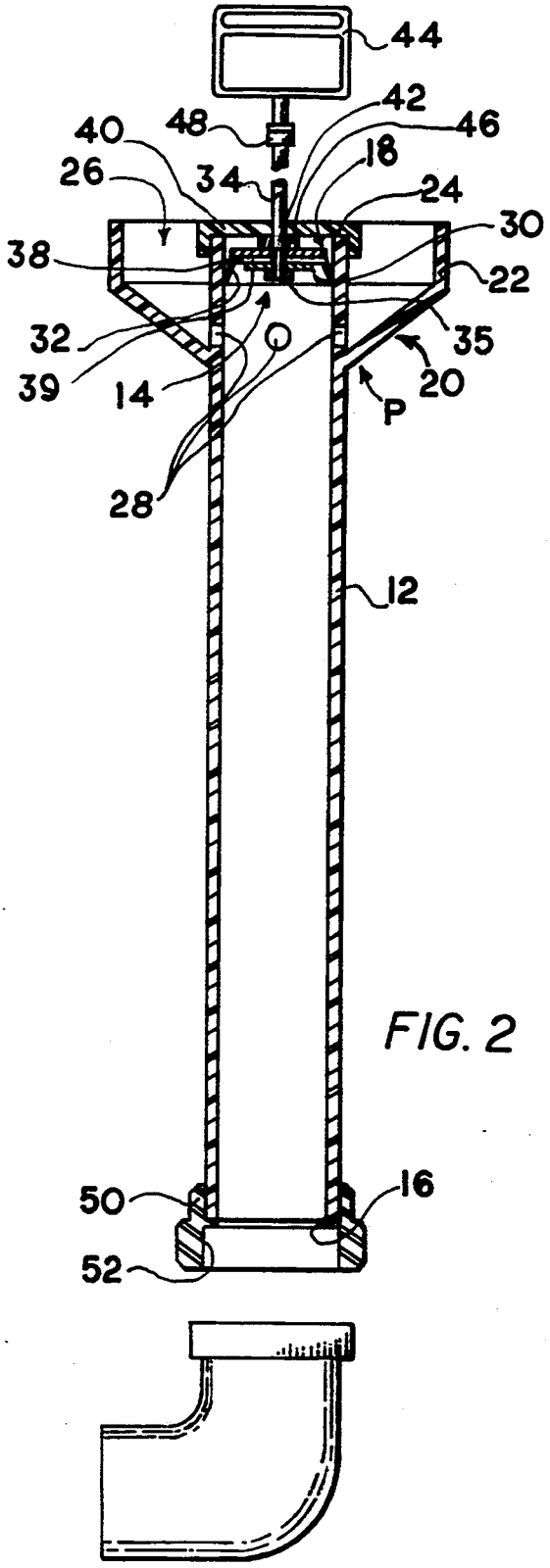
FIG. 2, in a longitudinal cross-sectional view taken along arrows 2—2 of FIG. 1, illustrates the internal mechanism of a drain flushing device in accordance with a first embodiment of the present invention.

Referring to FIG. 1, there is illustrated in a perspective view, a drain flushing device 10 in accordance with a first embodiment of the present invention. The drain flushing device 10 has a substantially cylindrical body 12 and a piston element 14 adapted to reciprocate inside the cylinder 12. The cylinder 12 has a lower discharge aperture 16 and an upper aperture 18 with an upper peripheral rim 24. A substantially funnel-shaped liquid guide 20 extends integrally from the cylindrical body 12 adjacent its upper aperture 18. The funnel shaped liquid guide 20 has a peripheral wall 22 which merges into the cylindrical body 12 at a peripheral junction position indicated by the reference letter P located underneath the upper peripheral rim 24 of the aperture 18. The guide 20 and the upper portion of the cylinder 12 thus define a substantially annular cavity 26 positioned peripherally around the upper portion of the cylinder 12 into which a liquid can be poured. The cylindrical body 12 is provided with a set of peripheral apertures 28 extending there through. The apertures 28 are located intermediate the upper rim 24 and the peripheral junction position P and are thus adapted to allow the liquid poured into the annular cavity 26 to flow into the cylinder 12.

The piston element 14 comprises a piston disk 30 having integrally and downwardly extending peripheral sealing flanges 32 adapted to slidably abut against the inner wall of the cylinder 12. The disk 30 is fixed to an elongated piston rod 34 by a bolt 35 extending through the disk 30 and threadaly inserted into a corresponding longitudinal threaded recess 36 provided in the lower end of the piston rod 34. A rigid spacing disk 38 is provided between the bolt 35 and the disk 30. A cover cap 40 is fittingly positioned on top of the cylinder 12. The cap 40 has a central aperture 42 extending there through. The piston rod 34 is adapted to slidably extend through the aperture 42 of the cap 40. A handle 44 is rigidly fixed to the top end of the piston rod 34 for allowing manual operation of the piston element 14.

Cushioning disks 46 and 48 made of relatively resilient material, are respectively positioned on the rod 34 adjacent the disk 30 and the handle 44 for limiting the course of the piston element 14 and preventing the disk 30 and the handle 44 from knocking on the cap 40. The disks 46 and 48 thus absorb the impact created by the reciprocation of the piston rod 34. A ring adapter 50 fittingly positioned on the lower end 16 of the cylinder 12 is provided with a recess 52. The recess 52 is adapted to slidably receive and fittingly lock a set of angled elbows configured to various sizes, shapes and configurations allowing insertion in correspondingly shaped drain apertures.

Figure 3:
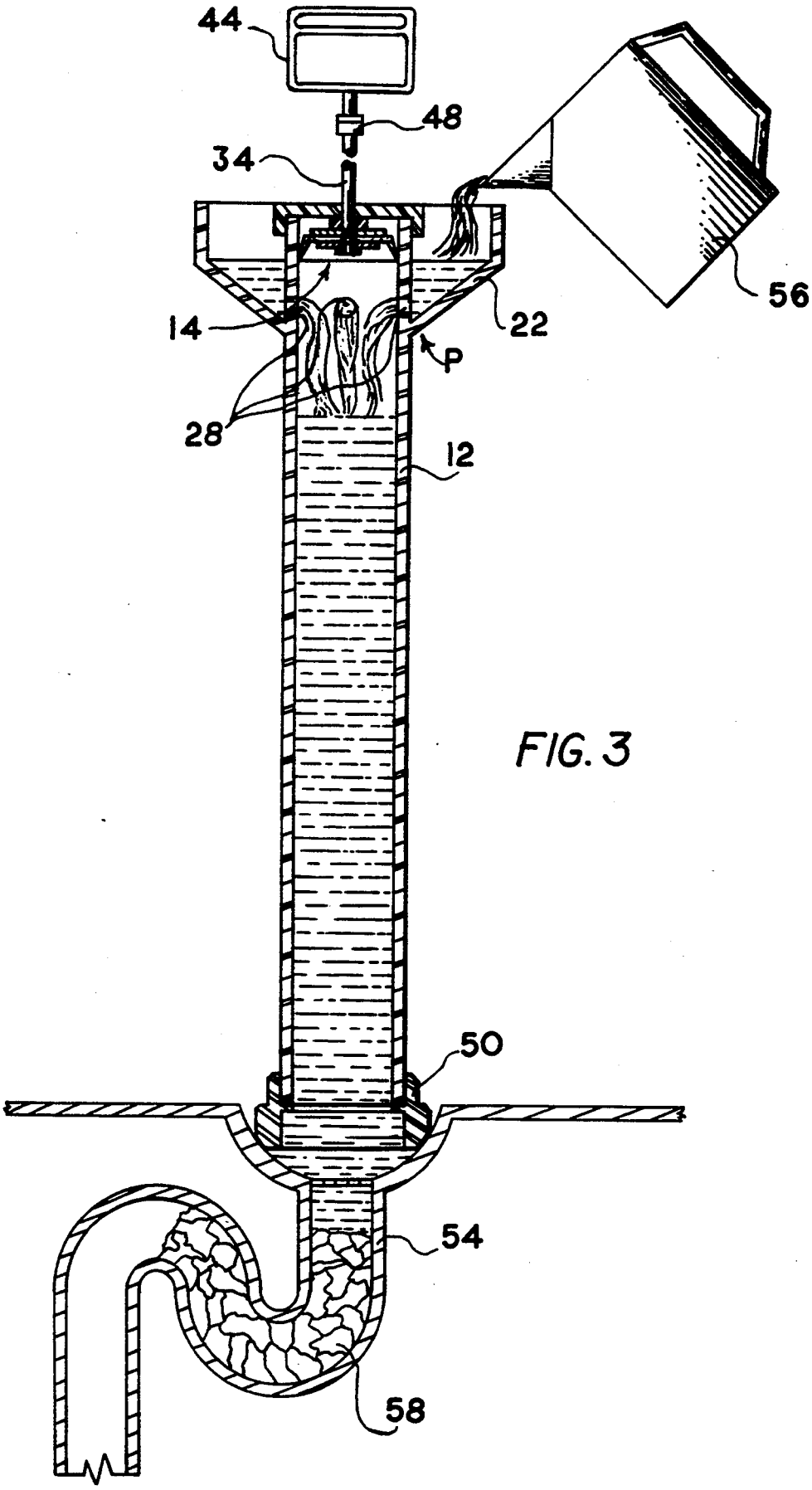
FIG. 3, in a longitudinal cross-sectional view, illustrates a drain flushing device in accordance with a first embodiment of the present invention in which water is being poured in order to form a water column.

In use, the drain flushing device 10 is adapted to be used in two modes. According to one mode, as shown in FIG. 3, the user pulls up the handle 44 until the piston element 14 is positioned above the set of apertures 28, then positions the lower open end 16 of the cylinder 12 on the opening of a clogged drain 54. The user then pours water from a container, such as container 56, into the substantially funnel-shaped liquid guide 20. The water then freely flows through the set of apertures 28 substantially filling the cylinder 12 thus forming a column of water that exerts pressure on a clogging matter 58 in the drain 54, for releasing the clogging matter 58 in the drain 54. A column is thus formed using gravity, contrary to Canadian Patent No. 299,247 granted on Apr. 15, 1929 to Krieger, U.S. Pat. No. 3,934,280 granted on Jan. 27, 1976 to Tancredi, and U.S. Pat. No. 4,186,451 granted on Feb. 5, 1980 to Ruo wherein the forming of a column of water needs the use of pressure.

Figure 4:
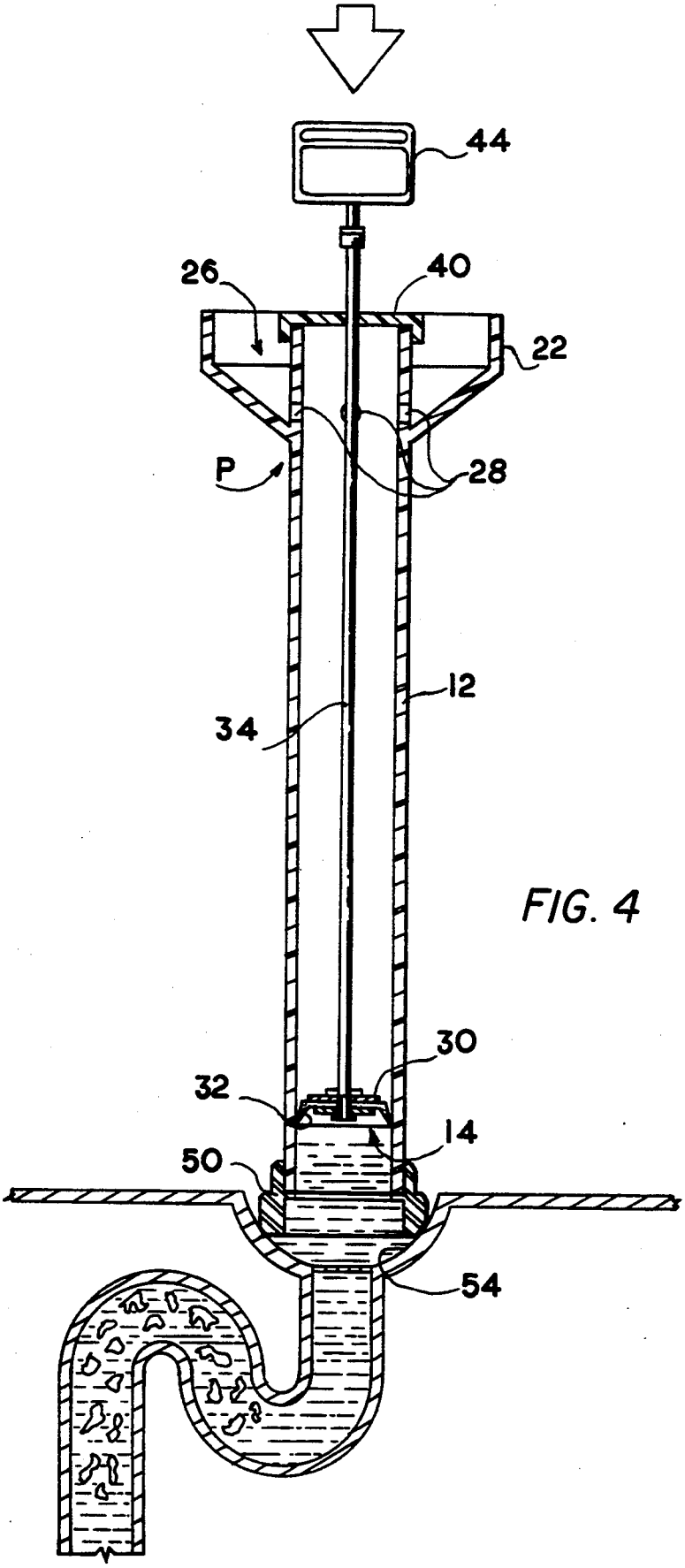
FIG. 4, in a longitudinal cross-sectional view, illustrates a drain flushing device in accordance with a first embodiment of the present invention with its piston being pushed in a downward motion.
Figure 5:
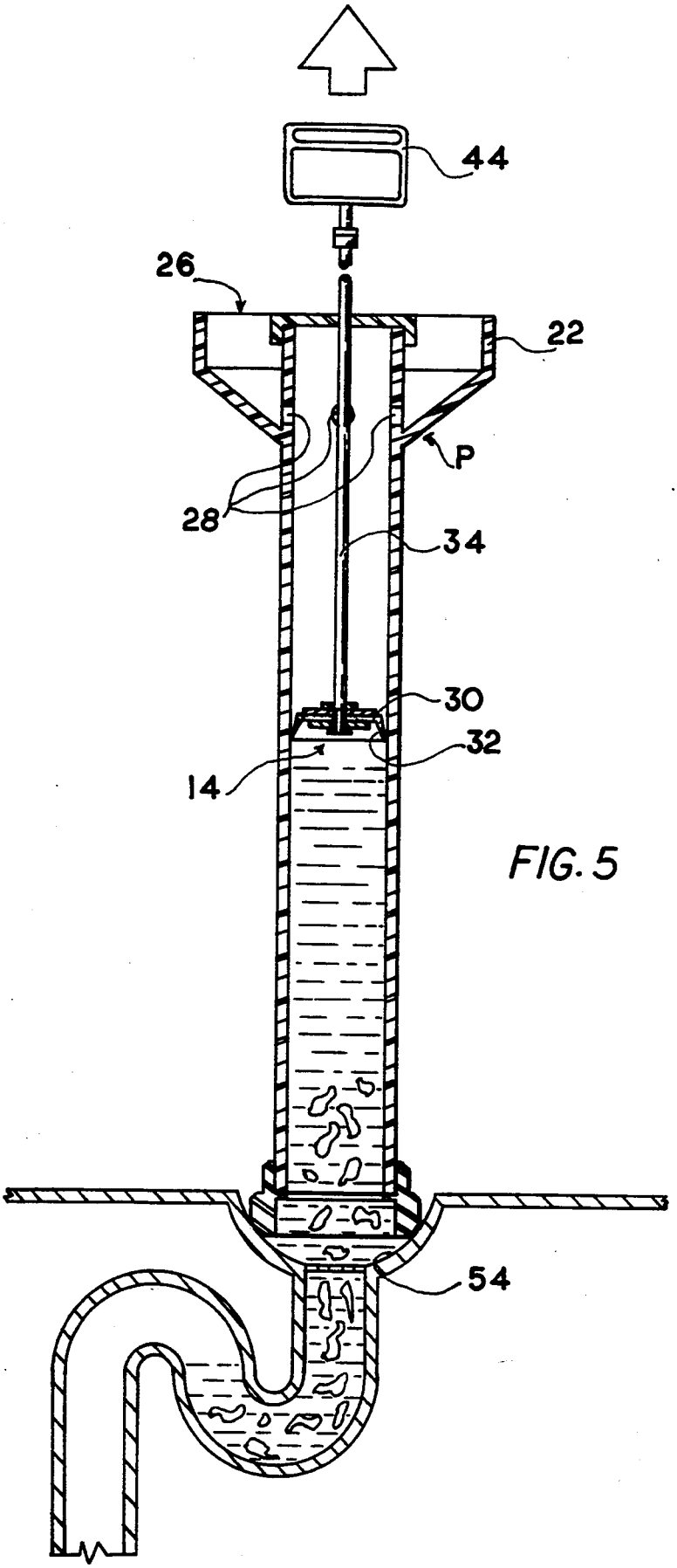
FIG. 5, in a longitudinal cross-sectional view, illustrates a drain flushing device in accordance with an embodiment of the present invention with its piston being pulled upwardly.

According to an alternative mode, as illustrated in FIG. 4, once the water has been poured into the substantially funnel-shaped liquid guide 20 and substantially fills the cylinder 12, the user holds the cylinder 12 with one hand and pushes down and pulls up the handle 44 with the other hand, thus reciprocating the piston element 14 inside the cylinder 12 and thereby alternately siphoning and exerting a downward pressure on the clogging matter 58 inside the drain 54 until the clogging matter 58 is released. With the present invention, it is also possible to siphon water that is inside the clogged drain 54, if readily accessible, instead of pouring water inside the substantially funnel-shaped liquid guide 20.

The embodiments of the invention in which an exclusive property or privilege is claimed are defined as follows:

1. A drain flushing device for unclogging a clogged drain comprising:

- a substantially elongated cylindrical body having a top end and a bottom end;
- a manually operable piston means having a piston disk adapted to reciprocate inside said cylindrical body between an upper position wherein said disk is positioned adjacent said upper end of said cylindrical body and a lower position wherein said disk is positioned adjacent said bottom end of said cylindrical body;
- said cylindrical body having an upper on said top end, a liquid inlet section positioned substantially adjacent said upper rim and a hydrostatic pressure building section, said liquid inlet section comprising:
- a set of inlet apertures extending radially through said cylindrical body;
- a substantially funnel shaped wall extending integrally from said cylindrical body and merging out from said cylindrical body at a merging position located directly underneath said inlet apertures, said substantially funnel shaped wall defining a peripheral cavity projecting only around said liquid inlet section;
- said hydrostatic pressure building section extending integrally from said liquid inlet section directly underneath said merging position, said hydrostatic pressure building section having a liquid-tight substantially elongated cylindrical wall preventing a volume of liquid contained inside said hydrostatic pressure building section from flowing through said wall and allowing said volume of liquid contained in said cylindrical wall to build a hydrostatic pressure corresponding to the height of said volume of water contained in said hydrostatic pressure building section.

2. A drain flushing device as recited in claim 1 wherein said cylindrical body has an inner wall and wherein said piston means comprises:

- a piston disk having an integrally and downwardly extending peripheral sealing edge adapted to slidably abut against said inner wall of said cylindrical body, said disk being fixed to an elongated piston rod;
- a handle rigidly fixed to an upper end of said piston rod.

3. A drain flushing device as recited in claim 1 wherein said cylindrical body has a sealing cap fittingly positioned over said upper rim of said cylindrical body, said sealing cap having a central aperture extending there through for allowing said piston rod to slidably move inside said aperture and said cylindrical body.

4. A drain flushing device as recited in claim 1 wherein said piston disk has a lower peripheral edge and wherein said liquid inlet cavities extend radially through said cylindrical body in a geometrical plane which is in register with said lower peripheral edge of said piston disk when said piston disk is in said upper position.

* * * * *